US008528483B2

(12) United States Patent
Sprainis et al.

(10) Patent No.: US 8,528,483 B2
(45) Date of Patent: Sep. 10, 2013

(54) CONSTANT CONTACT SIDE BEARING ASSEMBLY WITH IMPROVED HEAT DISSIPATION FOR A RAILCAR

(75) Inventors: Ronald J. Sprainis, Springfield, OR (US); Andrew Robitaille, Batavia, IL (US); Giuseppe Sammartino, Mount Prospect, IL (US); Jonathon Marlow, Hobart, IN (US); Pete Gregar, Chesterton, IN (US); Bradley Anderson, Des Plaines, IL (US)

(73) Assignee: WABTEC Holding Corp, Wilmerding, PA (US)

( * ) Notice: Subject to any disclaimer, the term of this patent is extended or adjusted under 35 U.S.C. 154(b) by 470 days.

(21) Appl. No.: 12/782,116

(22) Filed: May 18, 2010

(65) Prior Publication Data

US 2010/0294165 A1 Nov. 25, 2010

Related U.S. Application Data

(60) Provisional application No. 61/180,655, filed on May 22, 2009.

(51) Int. Cl.
*E01B 3/00* (2006.01)

(52) U.S. Cl.
USPC ..... 104/16

(58) Field of Classification Search
USPC ..... 105/157.1, 164, 199.1, 199.3, 392.5; 267/153, 269, 292, 293; 384/7, 9
See application file for complete search history.

(56) References Cited

U.S. PATENT DOCUMENTS

| | | | | |
|---|---|---|---|---|
| 4,712,487 | A | 12/1987 | Carlson | |
| 4,793,720 | A | 12/1988 | Merker, Jr. | |
| 5,601,031 | A | 2/1997 | Carlson | |
| 6,092,470 | A | 7/2000 | O'Donnell | |
| 6,792,871 | B2 * | 9/2004 | O'Donnell et al. | 104/16 |
| 2004/0129170 | A1 | 7/2004 | O'Donnell et al. | |

OTHER PUBLICATIONS

International Search Report; Written Opinion of the International Searching Authority.

* cited by examiner

*Primary Examiner* — R. J. McCarry, Jr.
(74) *Attorney, Agent, or Firm* — James Ray & Assoc

(57) ABSTRACT

A constant contact side bearing assembly for a railcar includes a housing having a base, a pair of mounting apertures formed through a thickness of the base, a generally cylindrical housing wall upstanding on the base, a pair of diametrically opposed channels, a pair of diametrically opposed openings and a guide member disposed centrally on and upstanding from an inner surface of the base. A cap is disposed for reciprocal axial movement relative to the housing. An elastomeric spring is disposed within a generally closed chamber formed by a combination of the housing and the cap. A pair of air passages is provided for dissipating heat generated during operation of the constant contact side bearing assembly. Each air passage is defined by a pair of aligned openings formed through a wall portion of the cap. Each opening may be disposed within a pocket provided within the cap wall.

17 Claims, 7 Drawing Sheets

CONSTANT CONTACT SIDE BEARING ASSEMBLY WITH IMPROVED HEAT DISSIPATION FOR A RAILCAR

CROSS-REFERENCE TO RELATED APPLICATIONS

This application is related to and claims priority from Provisional Patent Application Ser. No. 61/180,655 filed on May 22, 2009.

FIELD OF THE INVENTION

The present invention relates, in general, to energy absorption devices for railcars and, more particularly, this invention relates to a side bearing assembly which is employed between a bolster of a wheeled truck and an underside of the railcar body for accommodating "hunting" movements of the railcar and, yet more particularly, the instant invention relates to a constant contact side bearing having improved heat dissipation provided by openings formed through cap wall.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, constant contact side bearings are extensively employed on each truck of a railcar to accommodate and compensate for longitudinal vertical and side movements of the railcar body relative to such truck. As a result of such movements, heat is generated within the side bearing assembly and, more specifically, due to friction between the cap and the railcar body wear plate. While prior art side bearing assemblies have been found as capable of withstanding such heat, additional improvements are required.

Therefore, there is a need for a constant contact side bearing having improved heat dissipation.

SUMMARY OF THE INVENTION

The invention provides a constant contact side bearing assembly for a railcar. The constant contact side bearing assembly includes a housing. The housing includes a base having a substantially planar bottom surface thereof abuttingly engaging a bolster of a railway vehicle truck and defining a bottom end of the housing. There is a pair of mounting apertures that are formed through a thickness of the base and aligned along a mounting axis disposed each of generally perpendicular to an axis of the bolster and in a movement direction of the railcar. A generally cylindrical housing wall upstands on the base and defines an upstanding longitudinal axis of the housing, the upstanding longitudinal axis generally intersecting the mounting axis of the mounting apertures. There is also a pair of diametrically opposed channels that are disposed on and extend outwardly from an outer surface of the housing wall in open communication with an interior thereof and aligned along an axis disposed substantially perpendicular to the mounting axis. Each of the pair of diametrically opposed channels has a generally U-shaped cross-section in a plane transverse to the upstanding longitudinal axis of the housing. A top edge of the each of the pair of diametrically opposed channels is disposed generally planar with a top edge of the housing wall. A pair of diametrically opposed openings is provided and is formed through a thickness of the housing wall. Each of the pair of first diametrically opposed openings is disposed below a respective one of the pair of channels in general alignment therewith. A guide member is also disposed centrally on and upstands from an inner surface of the base. The constant contact side bearing assembly further includes a cap that is disposed for reciprocal axial movement relative to the housing. A compressible resilient member is provided and is disposed within a generally closed chamber formed by a combination of the housing and the cap. The compressible resilient member has an axial bore sized to receive the guide member. The final element of the constant contact side bearing assembly is means for dissipating heat. Such heat dissipating means is achieved by at least one air passage provided by a pair of pockets formed in the cap wall on each side of a tab operatively meshing with a respective channel and an opening formed through the vertical rear wall of each pocket.

The cap may have an elongated shape with the constant contact side bearing assembly further including a pair of spacers positioned within the housing on either side of the cap.

OBJECTS OF THE INVENTION

It is, therefore, one of the primary objects of the present invention to provide a constant contact side bearing assembly.

Another object of the present invention is to provide a constant contact side bearing assembly that has a pair of air passages disposed within the cap and aligned in a direction generally parallel to the mounting axis of the constant contact side bearing assembly.

Yet another object of the present invention is to provide a constant contact side bearing assembly that has grooves formed in the inner surface of the cap.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
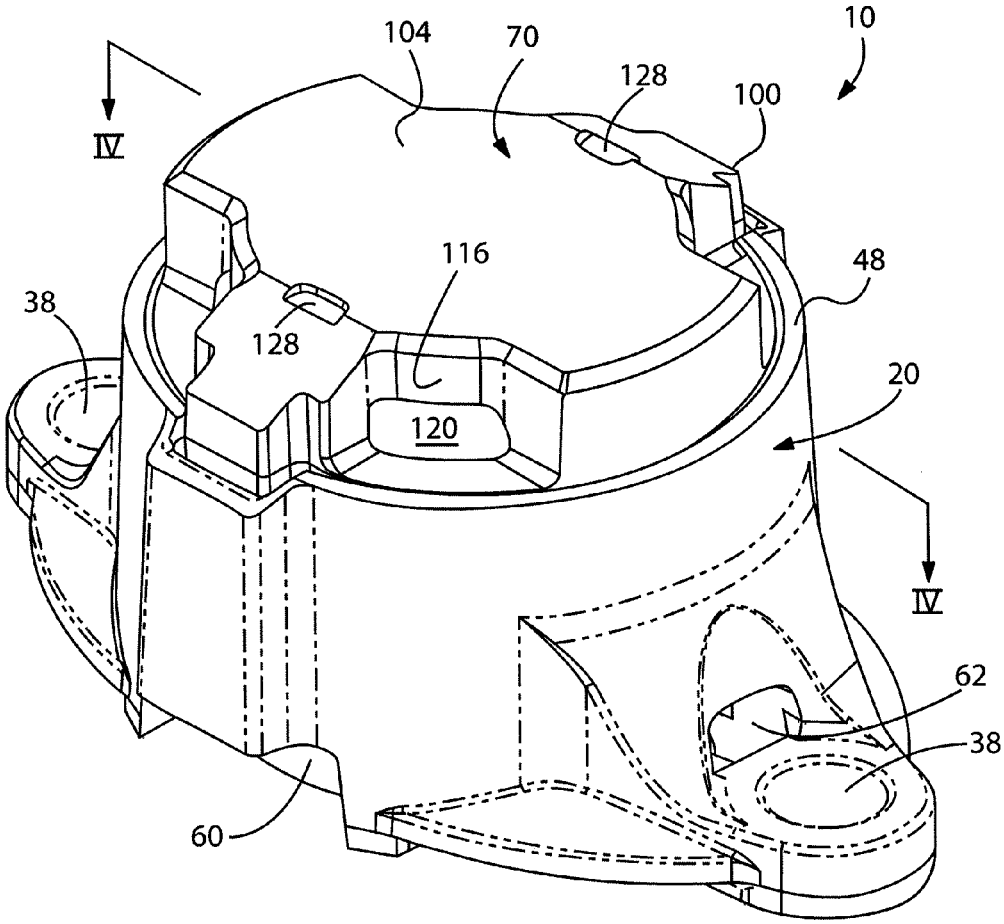
FIG. 1 illustrates a 3-D view of a constant contact side bearing assembly of the instant invention.

Prior to proceeding to the more detailed description of the present invention, it should be noted that, for the sake of clarity and understanding, identical components which have identical functions have been identified with identical reference numerals throughout the several views illustrated in the drawing figures.

The present invention provides a constant contact side bearing assembly, generally designated as 10, for a railcar 2 having improved heat dissipation. Now in a particular reference to FIGS. 1-4 and 9, the side bearing assembly 10 comprises a housing, generally designated as 20, a cap, generally designated as 70, and a resilient compressible element, generally designated as 140.

Figure 2:
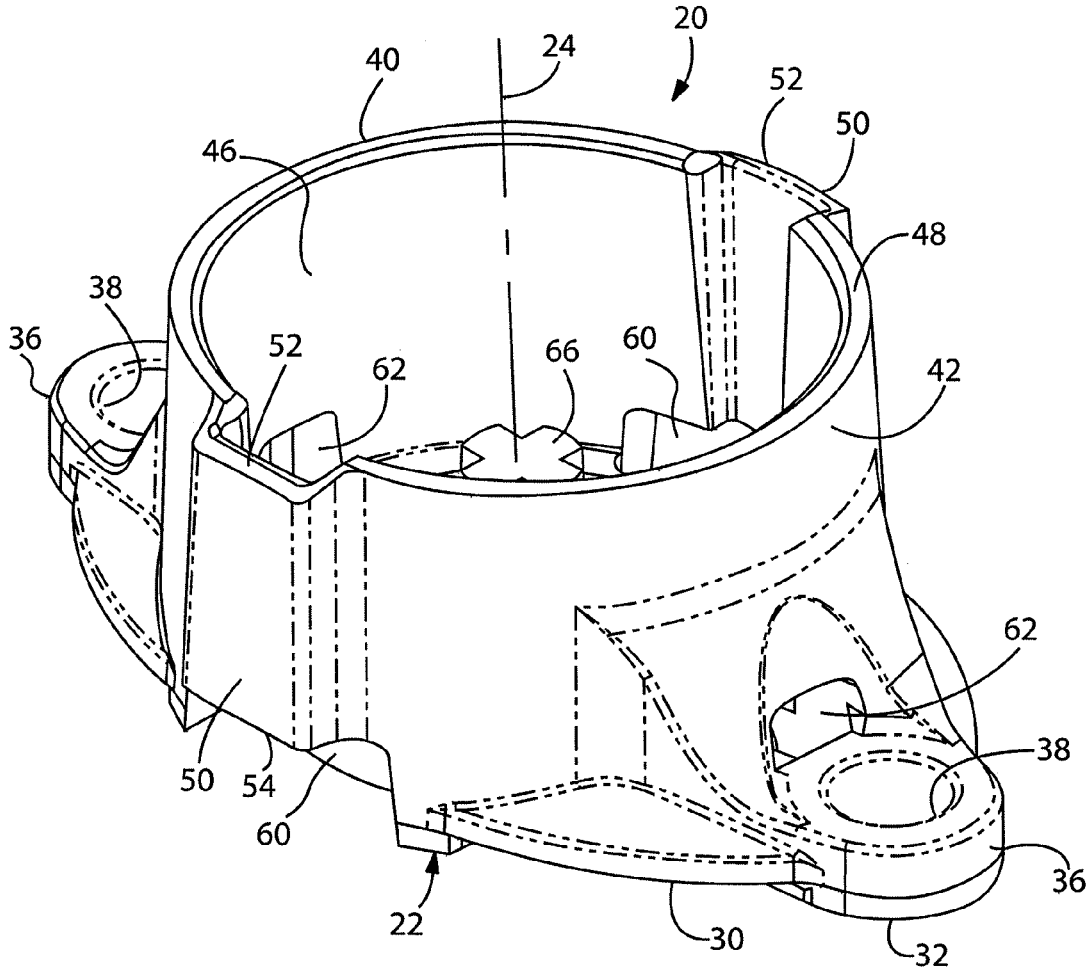
FIG. 2 illustrates a 3-D view of the housing member employed within the constant contact side bearing assembly of FIG. 1.

The housing 20, best shown in FIG. 2, includes a generally oval base 30 having a generally planar bottom surface 32 thereof abuttingly engaging the upper surface of the bolster 6 of a railcar truck 4 and defining a bottom end 22 of the housing 20. A pair of mounting apertures 38 are formed through a thickness of the base 30 and are aligned along a mounting axis 39 disposed each of generally perpendicular to an axis 5 of such bolster 6 and in a movement direction of such railcar 2. Each mounting aperture 38 is disposed in close proximity to and spaced from an end 36 of the base 30. The housing 20 has a generally cylindrical housing wall 40 upstanding on the base 30 and defining an upstanding longitudinal axis 24 of the housing 20 that generally intersects the mounting axis 39 of the mounting apertures 38. The housing wall 40 has each of a predetermined height and a predetermined diameter. As is conventional, the ends 36 of the base 30 extend past the outer side surface 42 of the housing wall 40 so as to allow unobstructed access to the apertures 38.

Two diametrically opposed channels 50 are disposed on and extend outwardly from the outer surface 42 of the housing wall 40 in open communication with an interior 46 thereof and aligned along an axis disposed substantially perpendicular to the mounting axis 39 and aligned with the axis 5 of the bolster 6. Each channel has a generally U-shaped cross-section in a plane transverse to the longitudinal axis 24 of the housing 20. A top edge 52 of each channel 50 is positioned generally planar with a top edge 48 of the housing wall 40.

A pair of first diametrically opposed openings 60 are formed through a thickness of the housing wall 40. Each of the pair of first diametrically opposed openings 60 is disposed below a bottom edge 54 of a respective channel 50 in general alignment therewith. Thus, the bottom edge 54 of the channel 50 is spaced in a vertical direction from the bottom surface 32 of the base 30 when the constant contact side bearing assembly 10 is mounted on the railcar truck 4.

There is also a pair of second diametrically opposed openings 62 formed through the thickness of the housing wall 40. Each of the pair of second diametrically opposed openings 62 is disposed above a respective one of the pair of ends 32 of the base 30. Finally, a first elongated guide member 66 is disposed centrally on and upstands from a substantially planar inner surface 34 of the base 30.

Figure 3:
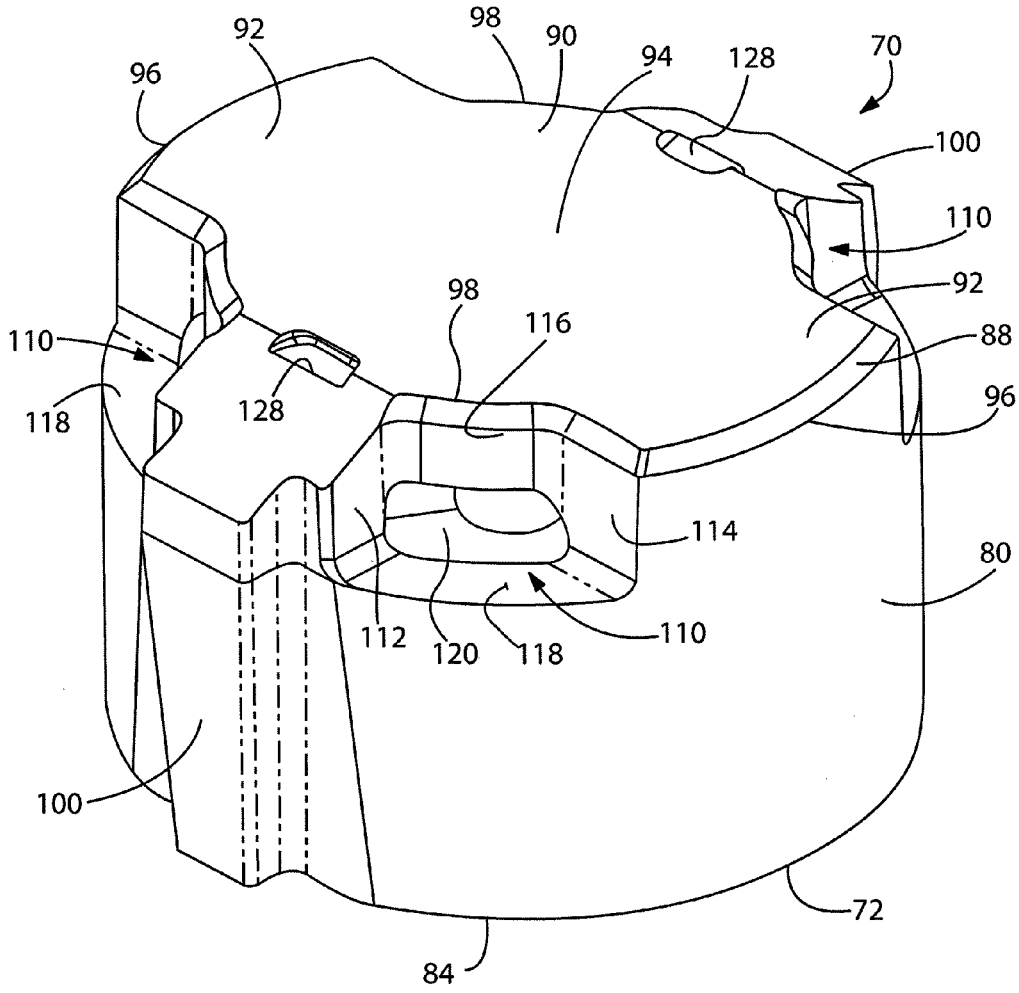
FIG. 3 illustrates a 3-D view of the cap member employed within the constant contact side bearing assembly of FIG. 1.
Figure 4:
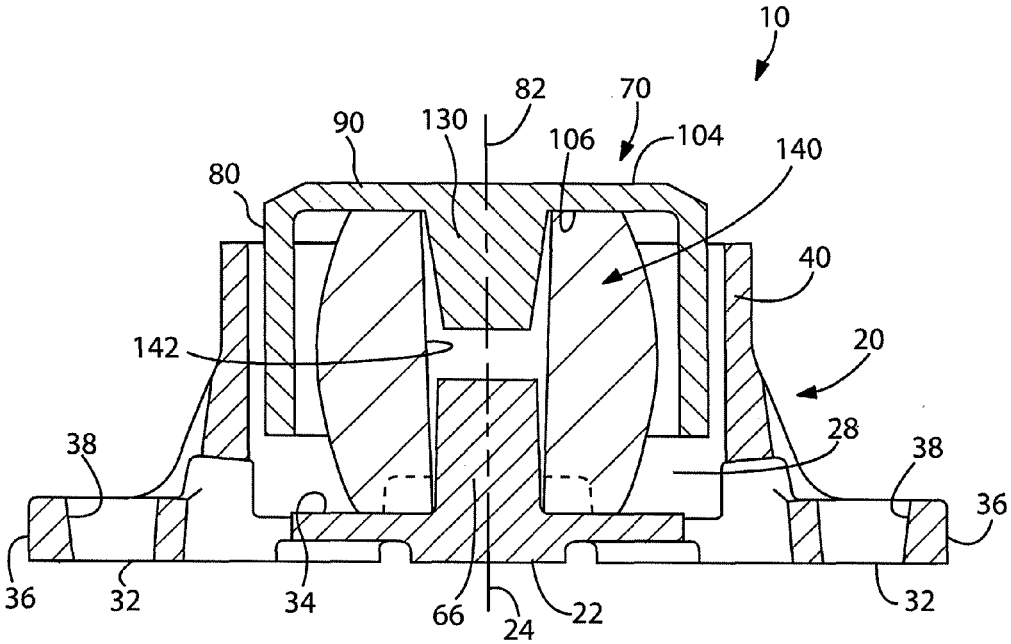
FIG. 4 is a cross-sectional view of the constant contact side bearing assembly along lines IV-IV of FIG. 1.

The cap 70, best shown in FIG. 3, is disposed for reciprocal axial movement relative to the housing 20. The cap includes a generally cylindrical cap wall 80 defining a longitudinal axis 82 disposed coaxially with the longitudinal axis 24 of the housing 20. The cap wall 80 has each of a predetermined height and a predetermined diameter. The cap 70 also has a generally open bottom end 72 defining a bottom edge 84 of the cap wall 80. There is also a generally closed top end 90 having a cross-sectional shape in the plane transverse to the longitudinal axis 82 of the cap 80 defined by a pair of diametrically opposed end portions 92 and a center portion 94. Each of the pair of end portions 92 has a convex end edge surface 96 complementing an exterior side surface 86 of the cap wall 80. The center portion 94 has a pair of convex edges 98. The top end 90 carries thereon each of a top edge 88 of the cap wall 80 and a substantially planar outer surface 89.

There is also a pair of diametrically opposed tabs 100 disposed on the exterior side surface 86 of the cap wall 80 and aligned along the axis disposed substantially perpendicular to the mounting axis 39. Each of the pair of diametrically opposed tabs 100 is sized for operative engagement with and axial reciprocal movement within a respective one of the pair of channels 50 so as to prevent rotation of the housing 70 about the longitudinal axis 82 during use of the constant contact side bearing assembly 10.

At least a pair and, preferably, a quartet of pockets 110 is defined by a combination of the pair of diametrically opposed end portions 92 of the top end 90 and the pair of diametrically opposed tabs 100. More specifically, each pocket 110 is defined by each of a first side surface 112 disposed in the substantially vertical plane on one side of the tab 100, a side wall 114 disposed in the substantially vertical plane and carrying a second side surface thereon, a rear wall 116 disposed in the substantially vertical plane and carrying a rear surface thereon and a ledge 118 disposed in a substantially horizontal plane and carrying thereon a bottom surface of the pocket 110. The rear wall 116 may have a curved convex cross-section in a plane transverse to the longitudinal axis 82 of the cap 70. Then, all four rear walls 116 are radially and equally spaced relative to the longitudinal axis 82 of the cap 70.

At least a pair and, preferably, a quartet of third openings 120 is also provided. Each of the quartet of third openings 120 is formed through the rear vertical wall 116 of a respective pocket 110 in open communication with the interior of the cap 70. Each third opening 120 has a generally elongated shape in the plane transverse to the longitudinal axis 82. The bottom edge of each third opening 120 is generally aligned with the bottom surface of the pocket 110 carried by the ledge 118. Furthermore, such bottom surface of the pocket 110 is positioned in a vertical direction on the cap wall 80 so that it remains aligned with or above the top edge 48 of the housing 20 during reciprocal motion of the cap 70 under all load conditions and further in view of the component wear occurring during use of the constant contact side bearing assembly 10.

Given the above described location of the pockets 110, each pair of third openings 120 forms an air passage in a substantially horizontal plane and in a direction substantially parallel to the mounting axis 39. When the pair of air passages is provided, the air passages are equally spaced from the mounting axis 39.

A pair of diametrically opposed wear indicators, such as pockets 128, are disposed in the outer surface 104 of the top end 90 of the cap 70.

A second elongated guide member 130 is disposed centrally on and upstands from a substantially planar inner surface 106 of the top end 90 of the cap 70.

The one piece compressible resilient member, such as elastomeric spring 140, is disposed within a generally closed chamber 28 formed by a combination of the housing 20 and the cap 70 for urging the cap 70 upwardly into contact with the underside of the railcar body (not shown). The elastomeric spring 140 has an axial bore 142 thereof sized to receive each of the first and second guide members, 66 and 130 respectively. The elastomeric spring 140 may be manufactured from any resilient compressible material capable of meeting performance mandated by the American Association of Railroads (AAR). By way of an example only, such elastomeric spring 140 may be manufactured from any thermoplastic or thermoset material. In the presently preferred form, the material of the elastomeric spring 140 is at least one of a copolyester polymer and a copolyamide material.

It is also within the scope of the instant invention to provide an indicator means (not shown) for indicating a nominal working height of the resilient side bearing assembly after such resilient side bearing assembly has been installed on the truck portion of the railway car. Such indicator means, as taught in the U.S. Pat. No. 4,793,720 issued to Merker, Jr. and owned by the assignee of the instant invention, includes a first portion positioned on the friction head member while a second portion of such indicator means is positioned on the housing member of the resilient side bearing assembly. Teachings of the U.S. Pat. No. 4,793,720 are incorporated into this document by reference thereto.

It has been found that in operation of the railcar 2, the third openings 120, which are essentially aligned in a direction of the railcar 2 movement, promulgate air flow through the chamber 28 for convection cooling, thus dissipating the heat generated during friction of the outer surface 104 of the top end 90 of the cap 70 with the railcar body wear plates (not shown). The frictional heating can be also exaggerated by increased cap to housing tolerances in a plane of hunting or truck rotation. Further heat dissipation is facilitated by the second openings 62 that are also aligned in a direction of the railcar 2 movement. Thus, the third openings 120 and, more particularly, air passages formed thereby either by themselves or in combination with the second openings 62 provides means, that are aligned in a direction of the railcar 2 movement, for dissipating heat generated during friction of the outer surface 104 of the cap 70 with the railcar body wear plates (not shown).

Figure 5:
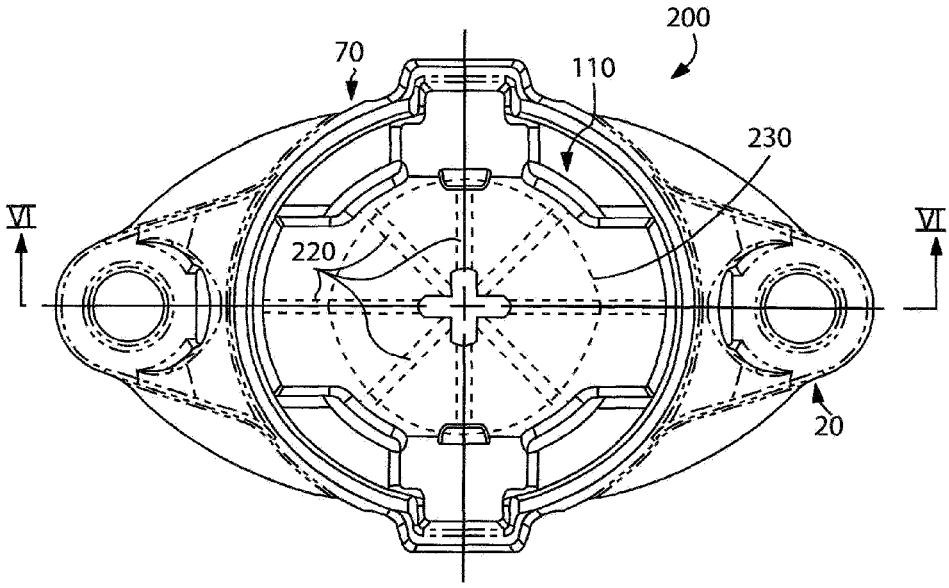
FIG. 5 is a top planar view of the constant contact side bearing assembly constructed in accordance with another embodiment of the invention.
Figure 6:
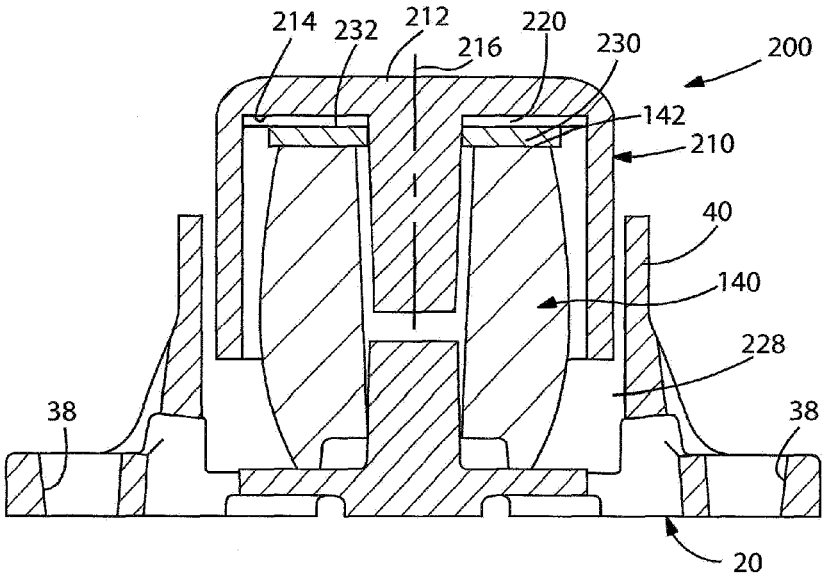
FIG. 6 is a cross-sectional elevation view of the constant contact side bearing assembly along lines VI-VI of FIG. 5.

Now in reference to FIGS. 5-6, therein is provided a side bearing assembly, generally designated as 200, which is constructed in accordance with another embodiment of the invention. The side bearing assembly 200 includes the above described housing 20 and the one piece elastomeric spring 140. The side bearing assembly 200 also includes a cap, generally designated as 210, which is constructed generally identical to the above described cap 70 except that the substantially planar inner surface 214 of the closed end 212 includes a predetermined plurality of grooves 220 disposed in a radial, or any other pattern, relative to the longitudinal axis 216 of the cap 210.

The side bearing assembly 200 further includes a spacer 230 manufactured from a rigid material, for example such as metal or any other material capable of withstanding operational loads. The spacer 230 is positioned between a substantially planar top end surface 142 of the elastomeric spring 140 and the substantially planar inner surface 214 of the closed end 212 of the cap 210. The grooves 220 having ends extending at least even with the outer edge of the spacer 230 and, preferably extending past such peripheral edge, permit dissipation of heat generated in the outer upper surface of the cap 210 first into the chamber 228 of the side bearing assembly 200 and then outwardly from this chamber through various openings in the housing 20 and the cap 210. The spacer 230 is provided in order to prevent degradation of the top end surface 142 of the elastomeric spring 140 and may be provided integral therewith by bonding or any other suitable method. It is also within the scope of the instant invention to provide grooves 220 in the upper surface 232 of the spacer 230 in combination with or alternative the grooves 220 disposed within the cap 210.

Although, the cap 210 is illustrated in FIG. 5 as having the above described pockets 110, it is within the scope of the instant invention to provide cap 210 without such pockets 110.

Figure 7:
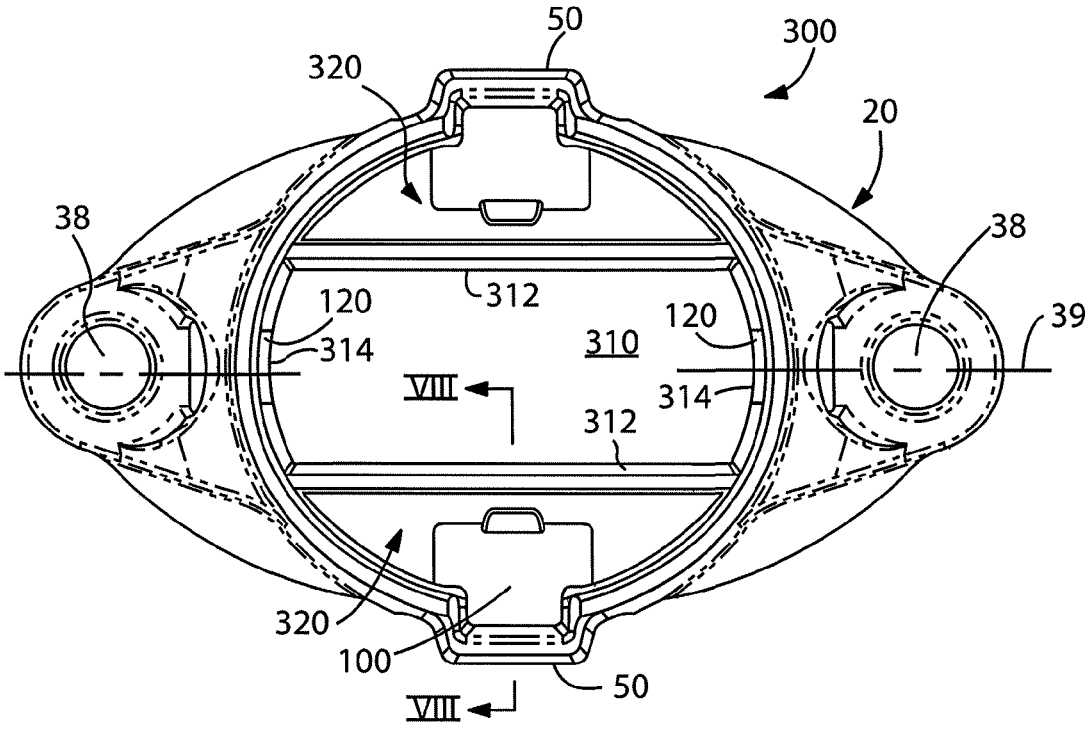
FIG. 7 is a top planar view of a constant contact side bearing assembly constructed in accordance with yet another embodiment of the invention.
Figure 8:
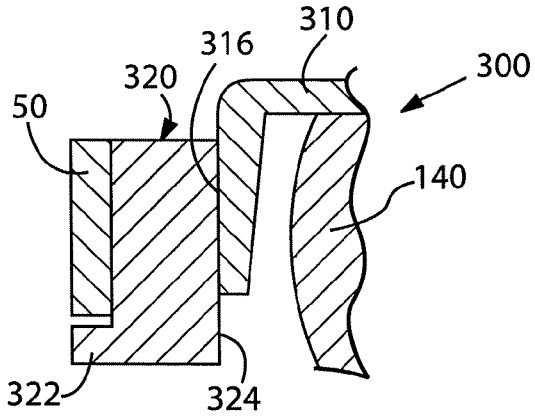
FIG. 8 is a partial cross-sectional elevation view of the constant contact side bearing assembly along lines VIII-VIII of FIG. 7.
Figure 9:
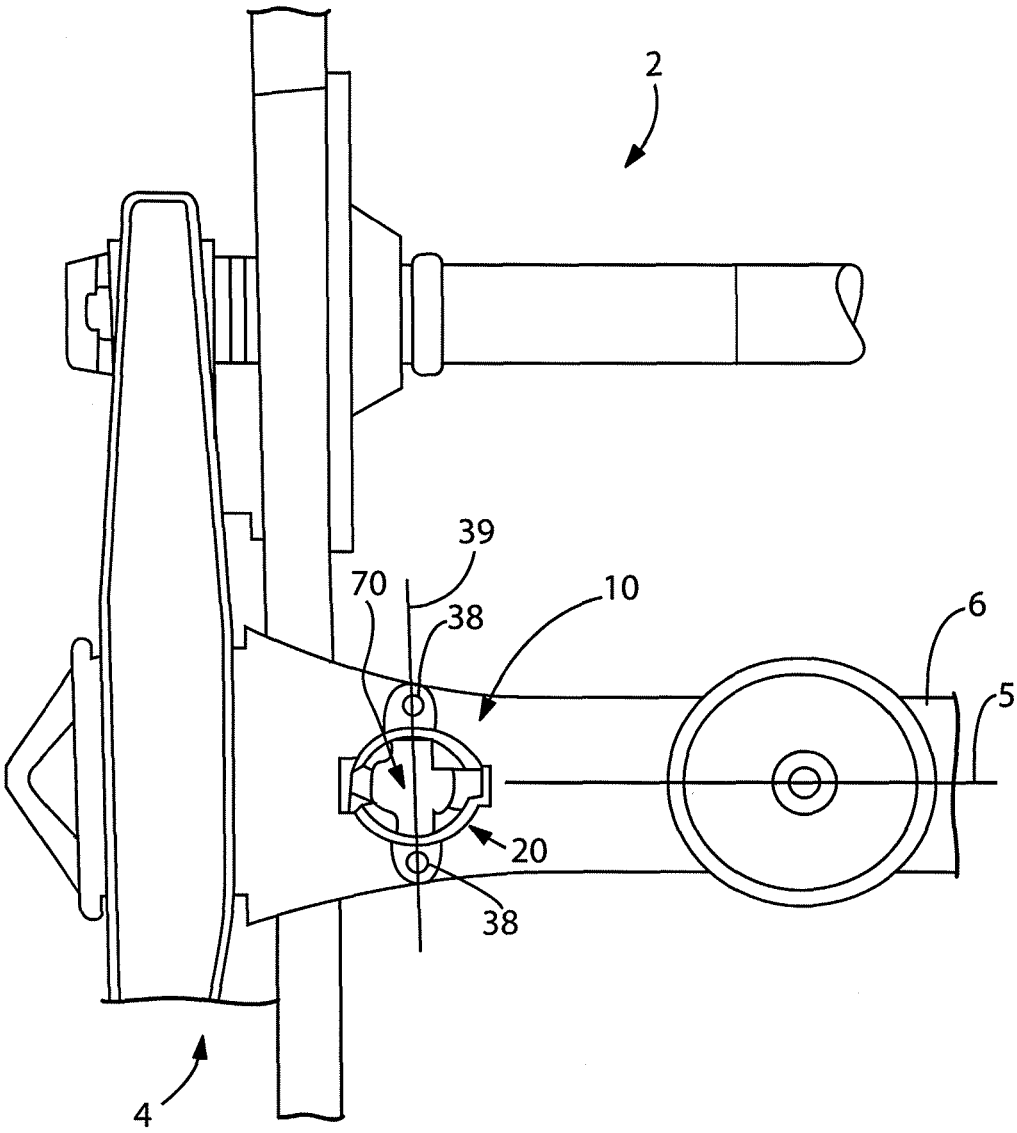
FIG. 9 is an environmental planar view illustrating use of the constant contact side bearing assembly of FIG. 1, 5 or 7 within a railcar.

Now in reference to FIGS. 7-8, therein is provided a side bearing assembly, generally designated as 300, which is constructed in accordance with another embodiment of the invention. The side bearing assembly 300 includes the above described housing 20 and the one piece elastomeric spring 140. The side bearing assembly 300 also includes a cap, generally designated as 310, that has a generally elongated shape and that is positioned for reciprocal axial movement within the housing 20. The cap wall of the cap 310 has each of a pair of opposed side wall portions 312 aligned in a direction substantially parallel to the mounting axis 39 and a pair of opposed convex end portions 314. Although, the side wall portions 312 are illustrated as having substantially planar outer surfaces 316, at least a middle section of such side wall portions 312 may be curved outwardly in a direction of the channels 50 to cooperate with the peripheral shape of the compressible elastomeric member 140.

The housing 310 also carries the above described guide member 130. Furthermore, the opening 120, or a similar opening, may be centrally formed through each convex wall portion 314, wherein the bottom edge of the opening 120 is disposed in alignment with or above the top edge of the housing 20.

There is also a pair of spacers 320 that are shaped to engage the inner surface of the housing 20 and, more particularly, operatively mesh with channels 50. Each spacer 320 carries a tab 100 thereon and also has a locking tab 322 caged within a respective one of the pair of diametrically opposed openings 60 of the housing 20. The inner surface 324 of the spacer 320 abuttingly engages the outer surface 316 of the side wall portion 312 of the cap 310. Although the spacer 320 is illustrated in FIG. 8 as a solid member, the spacer 320 may be also provided as a hollow member. Furthermore, when the side wall portion 312 has convex shape, inner wall 324 will have a complimentary concave shape.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A constant contact side bearing assembly for a railcar comprising:

(a) a housing (b) a cap disposed for reciprocal axial movement relative to said housing;

(c) a compressible resilient member disposed within a generally closed chamber formed by a combination of said housing and said cap; and (d) at least one air passage disposed in a direction being substantially parallel to a mounting axis of said housing and configured to dissipate heat from said generally closed chamber.

2. The constant contact side bearing assembly of claim 1, wherein said housing includes:

(a) a base having a substantially planar bottom surface thereof abuttingly engaging a bolster of a railway vehicle truck and defining a bottom end of said housing;

(b) a pair of mounting apertures formed through a thickness of said base and aligned along a mounting axis disposed each of generally perpendicular to an axis of the bolster and in a movement direction of the railcar;

(c) a generally cylindrical housing wall upstanding on said base and defining an upstanding longitudinal axis of said housing, said upstanding longitudinal axis generally intersecting said mounting axis of said mounting apertures;

(d) a pair of diametrically opposed channels disposed on and extending outwardly from an outer surface of said housing wall in open communication with an interior thereof and aligned along an axis disposed substantially perpendicular to said mounting axis, each of said pair of diametrically opposed channels having a generally U-shaped cross-section in a plane transverse to said upstanding longitudinal axis of said housing;

(e) a pair of diametrically opposed openings formed through a thickness of said housing wall, each of said pair of first diametrically opposed openings disposed below a respective one of said pair of channels in general alignment therewith; and (f) a guide member disposed centrally on and upstanding from an inner surface of said base.

3. The constant contact side bearing assembly, according to claim 2, wherein said cap includes:

(a) a generally cylindrical cap wall defining a longitudinal axis disposed coaxially with said longitudinal axis of said housing;

(b) a generally open bottom end defining a bottom edge of said cap wall;

(c) a generally closed top end having a cross-sectional shape in a plane transverse to said longitudinal axis of said cap defined by a pair of diametrically opposed end portions and a center portions, each of said pair of end portions having a convex end edge surface complementing an exterior side surface of said cap wall, said center portion having a pair of convex edges, said top end carrying thereon each of a top edge and a substantially planar outer end surface of said cap wall, said outer end surface positioned to abuttingly engage the railcar body portion;

(d) a pair of diametrically opposed tabs disposed on said exterior side surface of said cap wall and aligned along said axis disposed substantially perpendicular to said mounting axis, each of said pair of diametrically opposed tabs sized for operative engagement with a respective one of said pair of channels; and (e) a second guide member disposed centrally on and upstanding from an inner surface of said top end of said cap and received within said axial bore of said compressible resilient member.

4. The constant contact side bearing assembly, according to claim 3, wherein said at least one air passage includes two air passages disposed within said cap in a substantially horizontal plane when said constant contact side bearing assembly is mounted on said railcar and in said direction being substantially parallel to said mounting axis.

5. The constant contact side bearing assembly, according to claim 4, wherein each air passage includes:

(a) a pair of pockets disposed within said cap wall adjacent each side of one of said pair of diametrically opposed tabs, each of said pair of pockets having a rear wall disposed in a substantially vertical plane and a ledge disposed in a substantially horizontal plane, wherein said ledge remains aligned with or positioned above a top edge of said housing wall during reciprocal motion of said cap; and (b) a pair of openings, each of said pair of elongated openings formed through said rear wall of a respective pocket and elongated in a plane transverse to said longitudinal axis of said cap.

6. The constant contact side bearing assembly, according to claim 1, further including:

(a) a plurality of grooves formed in an inner surface of said closed top end of said cap; and (b) a spacer positioned between a top end surface of said compressible resilient member and said inner surface of said closed end of said cap.

7. The constant contact side bearing assembly, according to claim 1, wherein said at least one air passage includes a pair of diametrically opposed openings formed through a thickness of said housing wall and aligned along said mounting axis.

8. The constant contact side bearing assembly, according to claim 1, wherein said compressible resilient member is a one piece elastomeric spring.

9. The constant contact side bearing assembly, according to claim 1, wherein said cap includes at least a cap wall having each of a pair of opposed straight portions aligned in a direction substantially parallel to said mounting axis and a pair of opposed convex portions and wherein said constant contact side bearing assembly further includes a pair of spacers, each of said pair of spacers having:

(a) an inner surface thereof abuttingly engaging an outer surface of a respective one of said pair of straight portions of said cap wall;

(b) a tab operatively meshing with a respective one of said pair of channels; and (c) a locking tab caged within a respective one of said pair of diametrically opposed openings of said housing.

10. The constant contact side bearing assembly, according to claim 9, further including an opening centrally formed through each convex wall portion.

11. A constant contact side bearing assembly for a railcar comprising:

(a) a housing including:

(i) a base having a substantially planar bottom surface thereof abuttingly engaging a bolster of a railway vehicle truck and defining a bottom end of said housing;

(ii) a pair of mounting apertures formed through a thickness of said base and aligned along a mounting axis disposed each of generally perpendicular to an axis of the bolster and in a movement direction of the railcar, (iii) a generally cylindrical housing wall upstanding on said base and defining an upstanding longitudinal axis of said housing, said upstanding longitudinal axis generally intersecting said mounting axis of said mounting apertures, said housing wall having each of a predetermined height and a predetermined diameter, (iv) a pair of diametrically opposed channels disposed on and extending outwardly from an outer surface of said housing wall in open communication with an interior thereof and aligned along an axis disposed substantially perpendicular to said mounting axis, each of said pair of diametrically opposed channels having a generally U-shaped cross-section in a plane transverse to said upstanding longitudinal axis of said housing, and wherein a top edge of said each of said pair of diametrically opposed channels disposed generally planar with a top edge of said housing wall, (v) a pair of first diametrically opposed openings formed through a thickness of said housing wall, each of said pair of first diametrically opposed openings disposed below a respective one of said pair of channels in general alignment therewith, (vi) a pair of second diametrically opposed openings formed through said thickness of said housing wall and aligned along said mounting axis, and (vii) a first guide member disposed centrally on and upstanding from an inner surface of said base;

(b) a cap disposed for reciprocal axial movement relative to said housing, said cap including:

(i) a generally cylindrical cap wall defining a longitudinal axis disposed coaxially with said longitudinal axis of said housing, (ii) a generally open bottom end defining a bottom edge of said cap wall, (iii) a generally closed top end having a cross-sectional shape in a plane transverse to said longitudinal axis of said cap defined by a pair of diametrically opposed end portions and a center portions, each of said pair of end portions having a convex end edge surface complementing an exterior side surface of said cap wall, said center portion having a pair of convex edges, said top end carrying thereon each of a top edge and a substantially planar outer end surface of said cap wall, (iv) a pair of diametrically opposed tabs disposed on said exterior side surface of said cap wall and aligned along said axis disposed substantially perpendicular to said mounting axis, each of said pair of diametrically opposed tabs sized for operative engagement with a respective one of said pair of channels, (v) a quartet of pockets disposed within said cap wall adjacent each side of said pair of diametrically opposed tabs, each of said quartet of pockets having a rear wall disposed in a substantially vertical plane and a ledge disposed in a substantially horizontal plane, wherein said ledge remains aligned with or positioned above a top edge of said housing wall during reciprocal motion of said cap, (vi) a quartet of third openings, each of said quartet of third openings formed through said rear wall of said each pocket so that each pair of said third openings forms an air passage through an interior portion of said cap in a direction substantially parallel to said mounting axis, and (vii) a second guide member disposed centrally on and upstanding from an inner surface of said top end of said cap; and (c) one piece elastomeric spring disposed within a generally closed chamber formed by a combination of said housing and said cap, said compressible resilient member having an axial bore sized to receive each of said first and second guide members.

12. In combination with a constant contact side bearing assembly for a railcar having a housing and a compressible resilient member disposed therewithin, a cap mounted for reciprocal axial movement relative to said housing, said cap comprising:

(a) a generally cylindrical cap wall defining a longitudinal axis disposed coaxially with a longitudinal axis of said housing;

(b) a generally open bottom end defining a bottom edge of said cap wall;

(c) a generally closed top end having a cross-sectional shape in a plane transverse to said longitudinal axis of said cap, said generally closed top end defined by a pair of diametrically opposed end portions and a center portions, each of said pair of end portions having a convex end edge surface complementing an exterior side surface of said cap wall, said center portion having a pair of convex edges, said top end carrying thereon each of a top edge and a substantially planar outer end surface of said cap wall;

(d) a pair of diametrically opposed tabs disposed on said exterior side surface of said cap wall and aligned along said axis disposed substantially perpendicular to a mounting axis of said housing, each of said pair of diametrically opposed tabs sized for operative engagement with a respective one of a pair of channels of said housing;

(e) a guide member disposed centrally on and upstanding from an inner surface of said top end of said cap; and (f) at least one air flow passage disposed within said cap in a substantially horizontal plane when said cap is mounted for said reciprocal axial movement and in a direction substantially parallel to said mounting axis.

13. The cap, according to claim 12, wherein said at least one air flow passage is a pair of air flow passage disposed within said cap in a substantially horizontal plane when said cap is mounted for said reciprocal axial movement and in a direction substantially parallel to said mounting axis and equally spaced therefrom.

14. A constant contact side bearing assembly for a railcar comprising:

(a) a housing having each of a base, a pair of mounting apertures formed through said base, a generally cylindrical housing wall upstanding on an inner surface of said base and first guide member upstanding centrally on said base along longitudinal axis of said housing wall;

(b) a cap disposed for reciprocal axial movement relative to said housing and having each of a closed top end, a generally cylindrical cap wall upstanding on an inner surface of said closed top end and a second guide member upstanding centrally on an inner surface of said closed top end along longitudinal axis of said cap wall;

(c) a compressible resilient member disposed within a generally closed chamber formed by a combination of said housing and said cap, said compressible resilient member having an axial bore sized to receive each of said first and second guide members;

(d) a spacer positioned between a top end of said compressible resilient member and said inner surface of said closed top end; and (e) a plurality of grooves formed radially in at least one on said inner surface of said closed top end of said cap and an upper surface of said spacer.

15. A constant contact side bearing assembly for a railcar comprising:

(a) a housing including:

(i) a base having a substantially planar bottom surface thereof abuttingly engaging a bolster of a railway vehicle truck and defining a bottom end of said housing;

(ii) a pair of mounting apertures formed through a thickness of said base and aligned along a mounting axis disposed each of generally perpendicular to an axis of the bolster and in a movement direction of the railcar, (iii) a generally cylindrical housing wall upstanding on said base and defining an upstanding longitudinal axis of said housing, said upstanding longitudinal axis generally intersecting said mounting axis of said mounting apertures, said housing wall having each of a predetermined height and a predetermined diameter, (iv) a pair of diametrically opposed channels disposed on and extending outwardly from an outer surface of said housing wall in open communication with an interior thereof and aligned along an axis disposed substantially perpendicular to said mounting axis, each of said pair of diametrically opposed channels having a generally U-shaped cross-section in a plane transverse to said upstanding longitudinal axis of said housing, and wherein a top edge of said each of said pair of diametrically opposed channels disposed generally planar with a top edge of said housing wall, (v) a pair of diametrically opposed openings formed through a thickness of said housing wall, each of said pair of first diametrically opposed openings disposed below a respective one of said pair of channels in general alignment therewith, and (vi) a guide member disposed centrally on and upstanding from an inner surface of said base;

(b) an elongated cap disposed for reciprocal axial movement relative to said housing and defining a cap wall having each of a pair of opposed side wall portions aligned in a direction substantially parallel to said mounting axis and a pair of opposed end portions, each having a convex shape;

(c) a pair of spacers, each of said pair of spacers having:

i. an inner surface thereof abuttingly engaging an outer surface of a respective one of said pair of side wall portions of said cap wall, ii. a tab operatively meshing with a respective one of said pair of channels, and iii. a locking tab caged within a respective one of said pair of diametrically opposed openings of said housing; and (d) a compressible resilient member disposed within a generally closed chamber formed by a combination of said housing and said cap, said compressible resilient member having an axial bore sized to receive at least said guide member of said housing.

16. The constant contact side bearing assembly, according to claim 15, further including an opening centrally formed through each convex wall portion.

17. In combination with a constant contact side bearing assembly for a railcar having a housing, a compressible resilient member disposed therewithin, and a cap mounted for reciprocal axial movement relative to said housing, said housing comprising:

(a) a base having a substantially planar bottom surface thereof abuttingly engaging a bolster of a railway vehicle truck and defining a bottom end of said housing;

(b) a pair of mounting apertures formed through a thickness of said base and aligned along a mounting axis disposed each of generally perpendicular to an axis of the bolster and in a movement direction of the railcar;

(c) a generally cylindrical housing wall upstanding on said base and defining an upstanding longitudinal axis of said housing, said upstanding longitudinal axis generally intersecting said mounting axis of said mounting apertures;

(d) a pair of diametrically opposed channels disposed on and extending outwardly from an outer surface of said housing wall in open communication with an interior thereof and aligned along an axis disposed substantially perpendicular to said mounting axis, each of said pair of diametrically opposed channels having a generally U-shaped cross-section in a plane transverse to said upstanding longitudinal axis of said housing;

(e) a guide member disposed centrally on and upstanding from an inner surface of said base; and (f) a pair of diametrically opposed openings formed through a thickness of said housing wall and aligned along said mounting axis, each of said pair of diametrically opposed openings disposed in close proximity to a respective one of said pair of mounting apertures.

* * * * *